US006322117B1

(12) United States Patent
James, Jr.

(10) Patent No.: US 6,322,117 B1
(45) Date of Patent: Nov. 27, 2001

(54) LIFTING TOOL FOR SAFE 105 DEGREE ROTATION

(75) Inventor: Frank Ward James, Jr., Athens, GA (US)

(73) Assignee: ABB T&D Technology Ltd., Zurich (CH)

( * ) Notice: Subject to any disclaimer, the term of this patent is extended or adjusted under 35 U.S.C. 154(b) by 0 days.

(21) Appl. No.: 09/473,880

(22) Filed: Dec. 28, 1999

(51) Int. Cl.[7] ..... B66C 1/42
(52) U.S. Cl. ..... 294/86.41; 294/67.5; 414/783
(58) Field of Search ..... 294/81.3, 81.4, 294/81.51, 81, 54, 67.21, 67.22, 67.31, 67.33, 67.5, 86.41, 90, 111, 68.26; 414/732, 738–741, 743, 783, 626, 422

(56) References Cited

U.S. PATENT DOCUMENTS

| | | | | |
|---|---|---|---|---|
| 1,712,870 | * | 5/1929 | Coe | 294/68.26 |
| 2,399,360 | * | 4/1946 | Lacey | 294/86.41 |
| 2,448,124 | * | 8/1948 | Roy | 414/738 |
| 3,436,116 | * | 4/1969 | Anderson | 294/86.41 |
| 4,595,225 | * | 6/1986 | Kemble et al. | 294/86.41 |
| 6,209,938 | * | 4/2001 | James, Jr. | 294/86.41 |

FOREIGN PATENT DOCUMENTS

| | | | | |
|---|---|---|---|---|
| 1207913 | * | 2/1960 | (FR) | 294/81.4 |

OTHER PUBLICATIONS

Drawings: (2 sheets) Lifting Tool for Safe 90 Degree Rotation: original concept applied to Vacuum Lifting Tool by F. James, 1991.

Drawings (1 sheets): Vacuum Handling Device Interlock Schematic & Adjusting Instructions, D.W. Zimmerman Mfg., Inc., 1991.

Drawing (1 sheet) Small Tank 90 Degree Rotating Grab—Air Control Arrangement, ABB Power T&D Company Inc., Aug. 6, 1991.

Drawings: (2 sheets) Side Elevation of Vacuum Lifting Tool Prior to Modification for Safe 90 Degree Rotation—Goodyear "Ortec" (1991); (Sh 1 of 2) Plan View of Vacuum Lifting Tool Prior to Modification for Safe 90 Degree Rotation, 1991 (Sh 2 of 2).

* cited by examiner

*Primary Examiner*—Janice L. Krizek
(74) *Attorney, Agent, or Firm*—Woodcock Washburn

(57) ABSTRACT

Lifting tools for safe, 105 degree, off-center rotation of large, heavy objects are disclosed. A lifting tool includes a bar that can be positioned generally parallel to a centerline of the object, and first and second clamps that are rotatably or slidably coupled to first and second ends of the bar, respectively. The clamps are adapted to secure the tool to edges of the object. The tool also includes a pivot arm that is rotatably coupled to the bar, which allows the object to be lifted, rotated up to 90 degrees, moved, and then set down. The pivot arm includes first and second chain sprockets disposed along a length thereof. A second pair of chain sprockets is coupled to the second chain sprocket via a common shaft. A pair of chain segments are attached to the pivot arm, and engage each of the second pair of chain sprockets. A first end of the pivot arm can be coupled to a hoist hook, for example, via a chain that engages the first and second chain sprockets, and is coupled to the bar at a point between the clamps.

6 Claims, 3 Drawing Sheets

LIFTING TOOL FOR SAFE 105 DEGREE ROTATION

RELATED APPLICATIONS

The subject matter disclosed herein is related to the subject matter disclosed in application Ser. No. 09/473,887; filed Dec. 28, 1999, now U.S. Pat. No. 6,209,938, titled "Lifting Tool For Safe 90 Degree Rotation," the contents of which are hereby incorporated by reference.

FIELD OF THE INVENTION

The present invention relates generally to lifting tools. More particularly, the present invention relates to a lifting tool for safe, 105 degree, off-center rotation of large, heavy objects.

BACKGROUND OF THE INVENTION

It is often necessary to lift large, heavy objects during a manufacturing process, such as, for example, during the process of painting steel enclosures (known as "tanks") for pad mounted transformers. These large, usually rectangular tanks can be painted in an automatic paint facility using the following process, for example.

The tanks are placed one at a time onto a carrier rack that can hold up to four tanks. The carrier rack can be adapted to be carried via a conveyor system to a paint vat, into which the carrier rack is dipped along with the tanks. Preferably, the tanks are oriented on the carrier rack to allow good coverage as they pass through the painting operation. For example, the tanks can be oriented horizontally (i.e., with one of the four side faces facing downward) by placing them on horizontal arms of the carrier rack.

Typically, the tanks are delivered to the conveyor system on a towed cart. To minimize the size of the cart needed, the tanks are positioned on the cart vertically (i.e., with the top or bottom face facing downward). Thus, not only must each tank be lifted off of the cart and onto the carrier, but each tank must also be rotated by about 90 degrees at the same time. Similarly, the painted tanks must be taken from the carrier, rotated by about 90 degrees, and moved back onto the cart.

As a tank typically weighs more than 50 pounds (and frequently up to as much as 100 pounds or more), a tank is too heavy and too large for an ordinary person to move from the cart to the carrier, or vice versa, without the aid of a lifting tool. U.S. Pat. No. 6,209,938 discloses and claims a lifting tool for safe 90 degree rotation of large heavy objects.

In certain applications, however, it is necessary to rotate the object by more than 90 degrees while lifting and moving the object from one location to another. For example, in the painting process described above, the arms of the carrier rack onto which the tanks are to be placed may not be horizontal. In such circumstances, it is often necessary to rotate the tank by as much as 105 degrees during the lifting and moving process. The lifting tool described in U.S. Pat. No 6,209,938, while suitable for 90 degree rotation, is not optimal for rotation in excess of 90 degrees. Thus, there is a need in the art for a lifting tool that can aid a person in lifting and moving large, heavy objects, while rotating the objects up to 105 degrees.

SUMMARY OF THE INVENTION

The present invention satisfies these needs in the art by providing lifting tools for safe, 105 degree, off-center rotation of large, heavy objects. The lifting tool uses the weight of the object itself to create an opposing rotational force nearly equal to the rotational force acting at the center of gravity. This stabilizes the object, and thus enables a person to rotate the object safely, as if the object were nearly balanced at the point of rotation.

A lifting tool of the invention includes a bar that can be positioned generally parallel to a centerline of the object, and first and second clamps that are coupled to first and second ends of the bar, respectively. The clamps can be rotatably coupled to the bar, or slidably coupled thereto. The clamps are adapted to secure the tool to edges of the object.

The tool also includes a pivot arm that is rotatably coupled to the bar, which allows the object to be lifted, rotated up to 105 degrees, moved, and then set down. The pivot arm includes a first pair of chain sprockets disposed along a length thereof. A second pair of chain sprockets is coupled to the second chain sprocket via a common shaft. A pair of chain segments are attached to the pivot arm, and engage each of the second pair of chain sprockets. A first end of the pivot arm can be coupled to a hoist hook, for example, via a chain that engages the first and second chain sprockets, and is coupled to the bar at a point between the clamps.

As the object is rotated and the pivot arm moves relative to the bar, the chain rotates the sprockets. The second pair of sprockets, along with the sprocket from the first pair to which they are coupled, move along pivot arm, thereby minimizing the component force as the object rotation passes through 90 degrees. This reduction in component force enables the user to continue to rotate the object through angles greater than 90 degrees.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific apparatus and methods disclosed.

DETAILED DESCRIPTION OF PREFERRED EMBODIMENTS

A lifting tool according to the present invention is a device that can be hung from a bridge crane hoist hook, for example, and used to safely lift and rotate a large object, such as a rectangular enclosure. The lifting tool uses the weight of the object to provide counter torque to help a person to safely rotate the object up to 105 degrees. In a preferred embodiment, the invention can be used to lift such an enclosure from a transport cart, and to rotate the enclosure up to 105 degrees so that it can be placed on arms of a process rack. Similarly, the invention can be used to unload an enclosure from the rack, rotate it up to 105 degrees, and place it back onto the cart.

The lifting tool requires no air or electric power assist to clamp the enclosure off-center from its center of gravity, and easily and safely rotate it up to 105 degrees. The tool also does not require the use of a counterweight to offset the weight of the object to be lifted and rotated. Such counterweights typically add undesirable additional weight to the system. A lifting tool of the present invention is a relatively small, lightweight tool that uses the weight of the object and a unique design of chains and sprockets to accomplish its intended purpose with a relatively small cost. Moreover, it provides an additional advantage in that it can be operated safely by one person.

First, a lifting tool for safe, 90 degree, off-center rotation will be described in connection with FIGS. 1A and 1B. Lifting tools for safe, 90 degree rotation of large heavy objects are described in greater detail in U.S. Pat. No. 6,209,938. A lifting tool according to the present invention for safe, 105 degree, off-center rotation of large heavy objects will then be described in connection with FIGS. 2A and 2B.

Figure 1B:
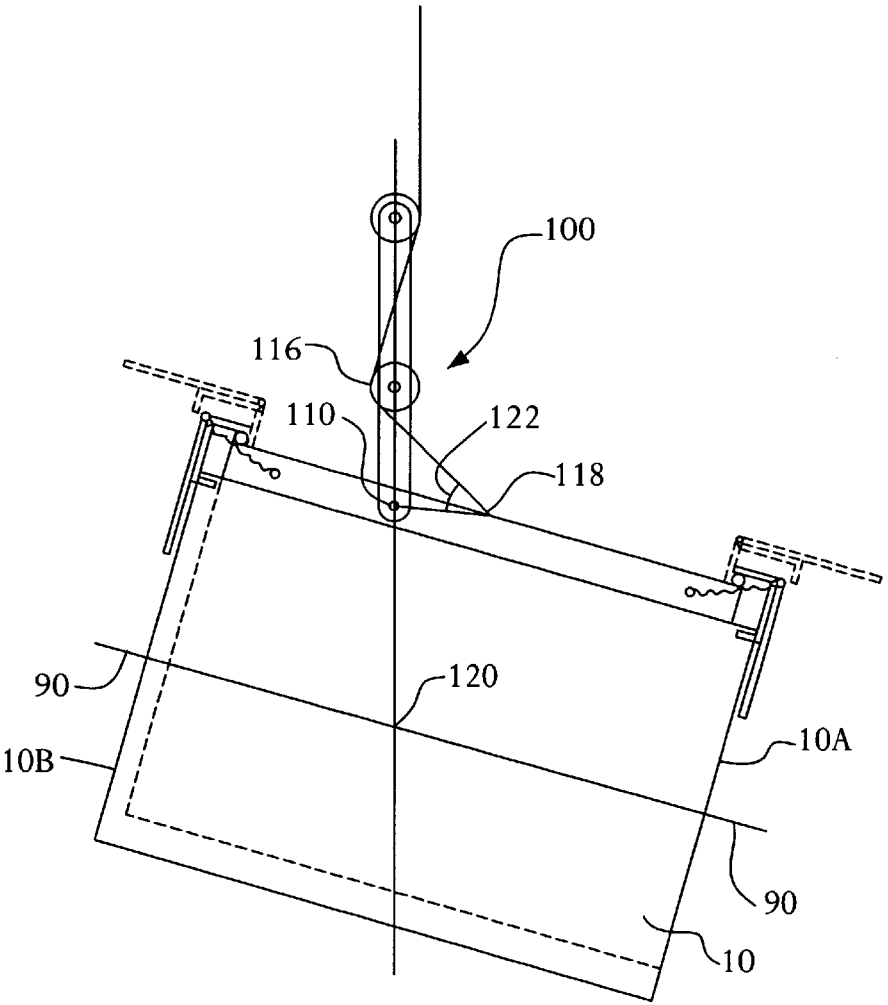
FIGS. 1A and 1B depict a lifting tool for safe, 90 degree, off-center rotation.
Figure 1A:
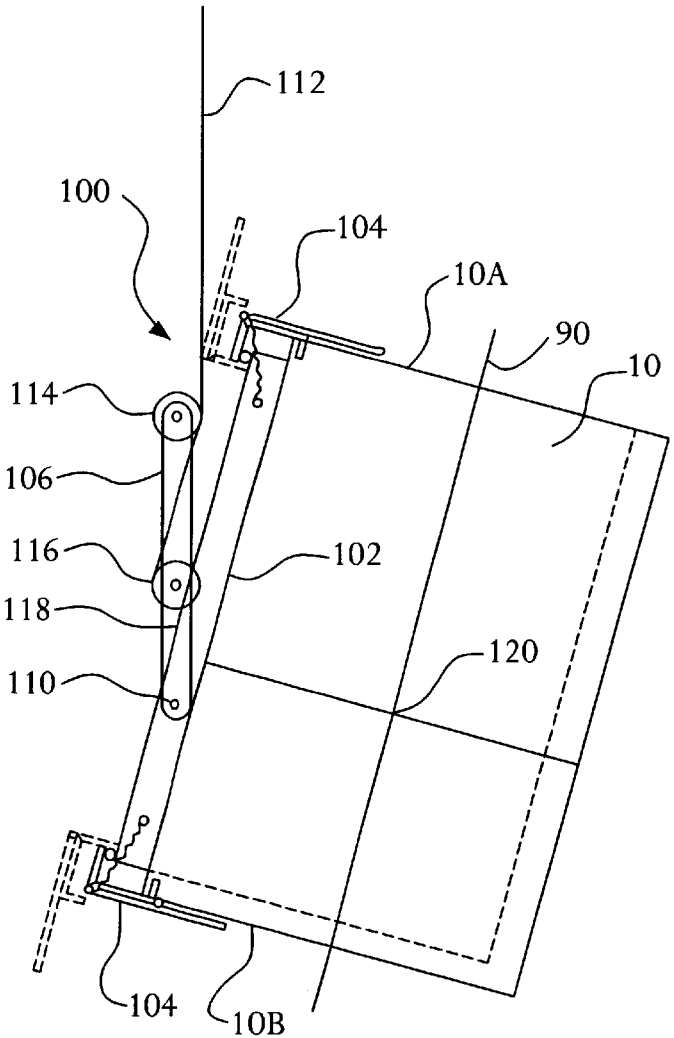

FIGS. 1A and 1B depict a lifting tool 100 for safe, 90 degree, off-center rotation. Basically, lifting tool 100 includes a bar 102 positioned generally parallel to a centerline 90 of an object 10. Tool 100 also includes a pair of clamps 104 to hold object 10 at top and bottom edges 10A, 10B thereof. Lifting tool 100 includes a pivot arm 106 that allows the object to be lifted, rotated up to 90 degrees, moved, and then set down. A first end of pivot arm 106 is coupled to a hoist hook (not shown) via a cable 112, while a second end of pivot arm 106 is attached to bar 102 at point 110. A first end of cable 112 is attached to bar 102 at point 118. Cable 112 wraps part way around idler pulleys 114 and 116. The other end of the cable 112 is attached to the bridge crane hoist hook.

Consider an exemplary object 10, such as a rectangular transformer tank, that weighs 100 pounds and is 20 inches deep front to back. Initially, the tanks sits in a vertical position on a delivery cart, and an operator wishes to lift the tank, rotate it 90 degrees, and then set it in a horizontal position on a paint conveyor. An operator can then simply clamp the lifting tool to one side the tank, and use the tool to lift the tank off of the cart. An operator can then simply clamp the lifting tool to one side the tank, and use the tool to lift the tank off of the cart.

Once tank 10 is lifted off the cart, it would try to rotate naturally (i.e., due to gravity) from the vertical position to the horizontal position. The force on the object's center of gravity would create a moment of 10 inches times 100 pounds or 1000 inch-pounds (i.e., 83 foot-pounds). Likewise, it would require 83 foot-pounds to rotate the tank from horizontal to vertical. The average person cannot handle this safely.

Lifting tool 100 is designed to use the weight of the object itself to create an opposing rotational force nearly equal to the rotational force acting at the center of gravity. This stabilizes the object, and thus enables a person to rotate the object safely, as if the object were nearly balanced at the point of rotation.

As shown in FIG. 1A, object 10 has a center of gravity at point 120. If the distance from pivot point 110 (i.e., the point at which pivot arm 106 attaches to bar 102) to center of gravity 120 is about equal to the distance from pivot point 110 to cable attachment point 118, then object 10 will be approximately balanced as it moves from vertical to horizontal. This is because, at this point, the full weight of object 10 hangs on cable 112. The tension on cable 112 curves around pulley 116 and creates a rotational force at cable attachment point 118 about pivot point 110. The rotational force at point 118 is in the opposite direction, and approximately equal, to the rotational force of the object's weight acting at center of gravity 120. As object 10 moves toward horizontal, the rotational force due to gravity is reduced as the distance from pivot point 110 to center of gravity 120 is reduced. This force is approximately balanced at cable attachment point 118 because the angle 122 formed by points 116, 118, and 110 is reduced, thereby reducing the component force at attachment point 118 perpendicular to a line through pivot point 110.

Figure 2:
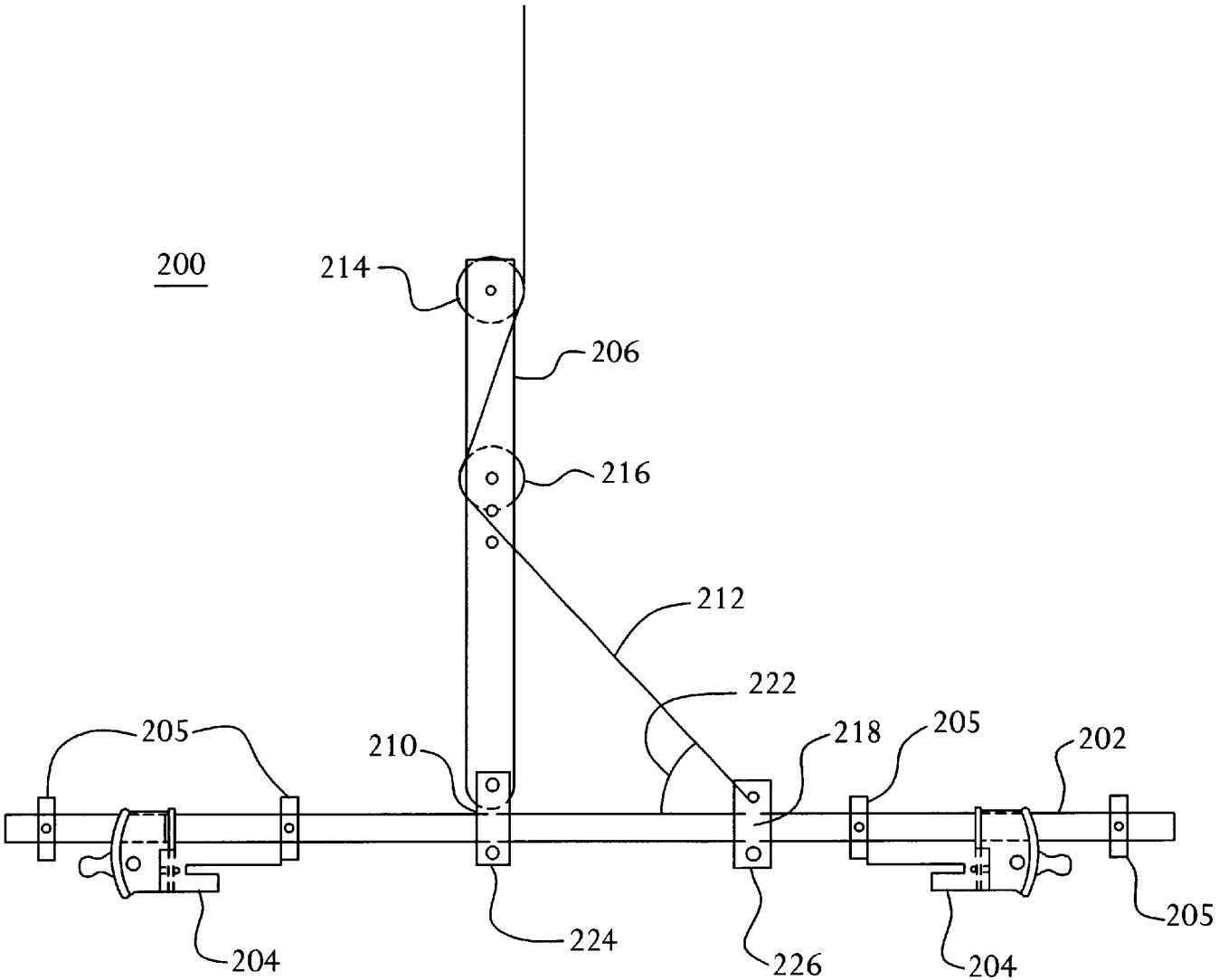
FIG. 2 depicts another lifting tool for safe, 90 degree, off-center rotation.

FIG. 2 depicts another lifting tool 200 for 90 degree rotation that includes a bar 202, such as, for example, a 36 inch long, ½-inch diameter, Sch. 80 pipe. Tool 200 also includes a pair of sliding clamps 204 to hold the object at its top and bottom edges, and a pair of collars 205 corresponding to each clamp that govern the extent to which each clamp can slide along bar 202. Lifting tool 200 includes a pivot arm 206 that allows the object to be lifted, rotated up to 90 degrees, moved, and then set down. A first end of pivot arm 206 is coupled to a hoist hook (not shown) via a cable 212, while a second end of pivot arm 206 is attached to bar 202 at point 210 via an attachment device 224.

A first end of cable 212 is attached to bar 202 at point 218 via a cable attachment device 226. Cable 212 wraps part way around idler pulleys 214 and 216. The other end of the cable 212 is attached to the bridge crane hoist hook. Preferably, cable attachment device 226 slides along bar 202 so that the balance can be optimized. Initially, cable attachment device 226 is positioned such that the distance from pivot point 210 to the object's center of gravity is about equal to the distance from pivot point 210 to cable attachment point 218. The position of cable attachment device 226 is then adjusted until the balance is optimized. The ability to adjust the position of cable attachment device 226 allows the user to account for the effects of the weight of tool 200.

When the object is horizontal, its center of gravity is directly beneath pivot point 210. Thus, the horizontal distance from pivot point 210 to the center of gravity is near zero and, consequently, the rotational torque is also near zero. At this point, agile 222 is about 45 degrees, and thus, there is a component perpendicular force to a line through pivot point 210 trying to rotate the object away from horizontal. When the object is rotated beyond 90 degrees, however, its center of gravity moves to the other side of pivot point 210. At this point, gravity will begin to cause the object to rotate in the same direction as the cable force. This combined force is greater than an average,e person can handle safely.

Figure 3B:
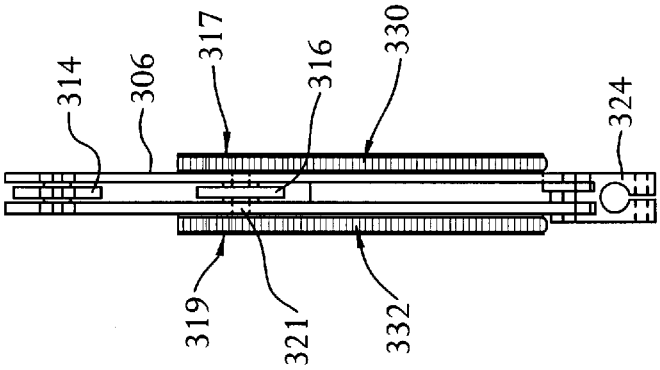
FIGS. 3A and 3B depict a lifting tool according to the present invention safe, 105 degree, off-center rotation.
Figure 3A:
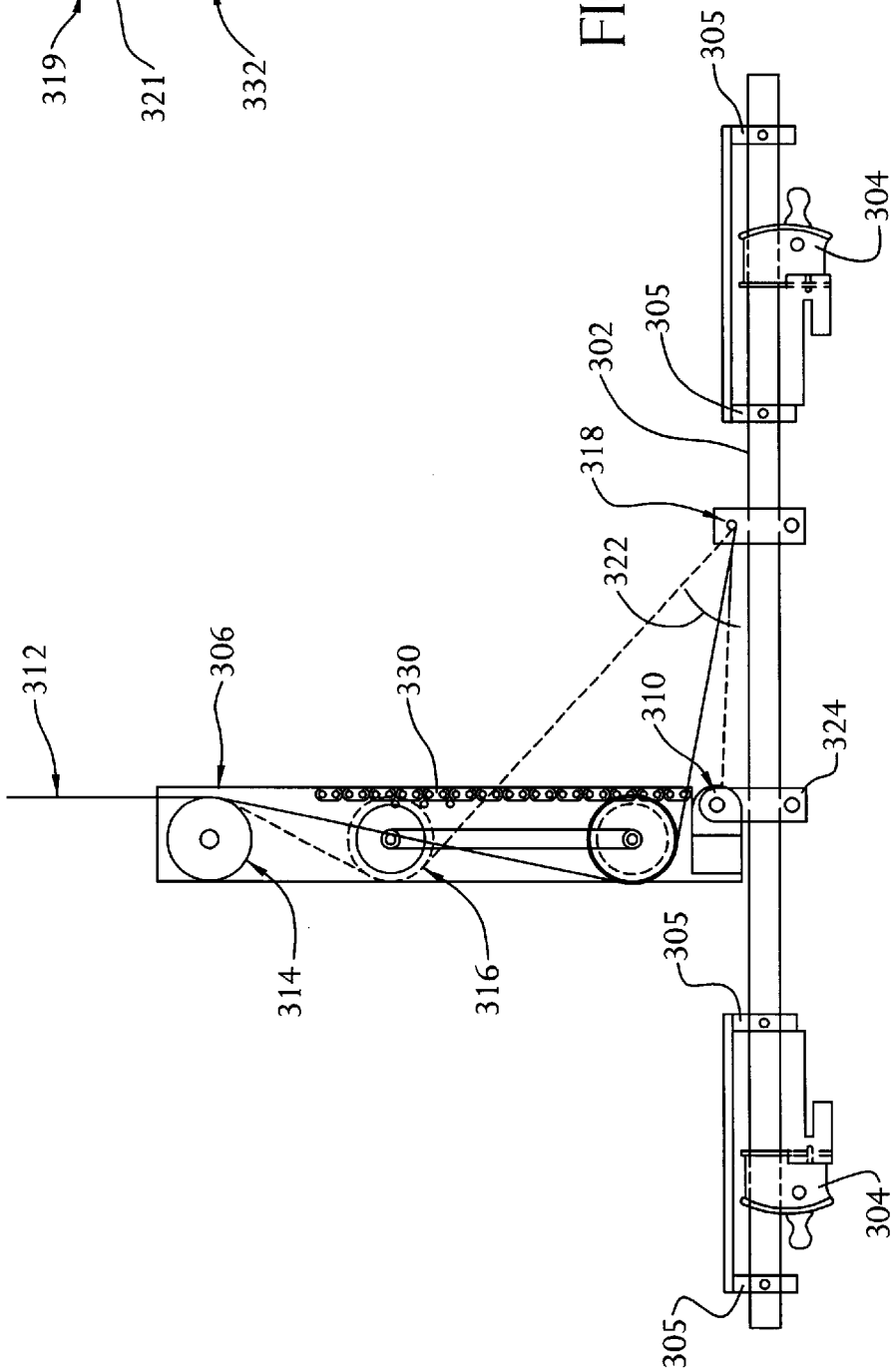

A lifting tool according to the present invention addresses this problem by minimizing angle 222 as the rotation of the object passes 90 degrees. As shown in FIGS. 3A and 3B, lifting tool 300 includes a bar 302 that is basically the same as bar 202 described above in connection with FIG. 2. Similarly, tool 300 also includes a pair of sliding clamps 304 to hold the object at its top and bottom edges, and a pair of collars 305 corresponding to each clamp that govern the extent to which each clamp can slide along bar 302. Lifting tool 300 includes a pivot arm 306 that allows the object to be safely lifted and rotated through angles of more than 90 degrees, preferably of lip to 105 degrees. A first end of pivot arm 306 is coupled to a hoist hook (not shown), while a second end of pivot arm 306 is attached to bar 302 at point 310 via an attachment device 324.

The main difference between tool 302 and tool 202 (see FIG. 2) is that pulleys 214 and 216 are replaced by chain sprockets 314 and 316, and cable 212 is replaced by a chain 312. Although point 310 can be located anywhere along bar 302, it is preferred that point 310 be somewhat off-centered to avoid interference between the tool and chain 312, as well as with anything that may be overhead (such as the above-described conveyor). Sprockets 316, 317, and 319 are keyed to a common shaft 321.

As the object is rotated and pivot arm 306 moves relative to bar 302, chain 312 rotates sprocket 316. Sprockets 317 and 319, which are coupled to sprocket 316 via shaft 321, engage chain segments 330 and 332, respectively, which are attached to pivot arm 306. Consequently, sprockets 316, 317, and 319, being keyed to common shaft 321, all move along pivot arm 306, thereby minimizing angle 322 (shown in dotted line in FIG. 3A). The component force is also minimized as the object rotation passes through 90 degrees. This reduction in component force enables the user to continue to rotate the object through angles greater than 90 degrees.

In a preferred embodiment, the tool is, sized and scaled for optimum balance during rotation up to 105 degrees, although it should be understood that a lifting tool according to the present invention can be sized and scaled to optimize performance at any desired angle of rotation.

Thus there has been described a preferred embodiment of a lifting tool for safe, 105 degree, off-center rotation. Although the present invention has been described with reference to large, rectangular enclosures, such as tanks for pad mounted transformers, it should be understood that a lifting tool according to the present invention can be used generally to balance a load held at a distance from the center of gravity where it is desired to have minimum force when rotation exceeds 90 degrees by a few degrees. Those skilled in the art will appreciate that numerous changes and modifications may be made to the preferred embodiment of the invention, and that such changes ,and modifications may be made without departing from the spirit of the invention. It is therefore intended that the appended claims cover all such equivalent variations as fall within the true spirit and scope of the invention.

I claim:

1. A tool for lifting and rotating an object, comprising:

a bar having a first end and a second end;

a first clamp coupled to the bar near the first end thereof and a second clamp coupled to the bar near the second end thereof;

a pivot arm rotatably coupled to the bar at a first point between the clamps, having a first chain sprocket and a second chain sprocket disposed along a length thereof, and wherein the second chain sprocket is coupled via a common shaft to a third chain sprocket and a fourth chain sprocket;

a first chain segment and a second chain segment attached to the pivot arm, wherein the third and fourth chain sprockets are engaged with the chain segments; and a chain that engages each of the first and second chain sprockets, and is coupled to the bar at a second point between the clamps.

2. The tool of claim 1, wherein the clamps are adapted to secure the tool to an edge of the object.

3. The tool of claim 1, wherein the clamps are rotatably coupled to the bar.

4. The tool of claim 1, wherein the clamps are slidably coupled to the bar.

5. The tool of claim 1, wherein the bar is a pipe.

6. The tool of claim 1, wherein the chain is coupled to the bar via a chain attachment device that is slidably coupled to the bar.

* * * * *